United States Patent [19]

Pouyer

[11] Patent Number: 4,922,598

[45] Date of Patent: May 8, 1990

[54] ASSEMBLY TABLE FOR MANUFACTURING OF MATS USED IN ROAD CONSTRUCTION

[76] Inventor: Joseph E. Pouyer, 13928 Aston, Houston, Tex. 77040

[21] Appl. No.: 220,572

[22] Filed: Jul. 18, 1988

[51] Int. Cl.[5] ..... B25B 27/14; A47B 5/06

[52] U.S. Cl. ..... 29/281.4; 29/281.1; 29/281.5; 29/281.6; 108/111; 108/156; 248/163.1; 404/34

[58] Field of Search ..... 108/111, 155, 156; 248/163.1, 165; 404/34; 52/127.3, 127.6; 29/281.1, 281.3, 281.4, 281.5, 281.6, 432; 269/118, 119

[56] References Cited

U.S. PATENT DOCUMENTS

| | | | |
|---|---|---|---|
| 867,661 | 10/1907 | Keating | 248/163.1 X |
| 1,808,082 | 6/1931 | Thompson | 248/165 X |
| 3,537,408 | 11/1970 | Bartlett | 108/156 |
| 4,039,132 | 8/1977 | Fournier | 248/163.1 X |
| 4,078,664 | 3/1978 | McConnell | 108/111 X |
| 4,330,921 | 5/1982 | White, Jr. | 29/281.4 X |
| 4,630,550 | 12/1986 | Weitzman | 108/111 X |

FOREIGN PATENT DOCUMENTS

| | | | |
|---|---|---|---|
| 135145 | 7/1985 | Japan | 29/281.4 |
| 1165571 | 7/1985 | U.S.S.R. | 29/281.4 |

OTHER PUBLICATIONS

Air Powered Nailers and Staplers and the Fasteners They Drive by SENCO (pamphlet).

Senstar Pallet System by SENCO (pamphlet).

*Primary Examiner*—Mark Rosenbaum

*Assistant Examiner*—Peter Dungba Vo

[57] ABSTRACT

A three-dimensional frame structure for guiding and positioning elements used in the construction of a mat for construction roads. The structure holds the components of the mat in position to insure uniformity of assembled mats. The uniformity is assured by providing a template to hold the components of a mat into position during the fabrication of the mats.

A method of a manufacture for mats for use in a artificial construction road which utilizes an assembly frame to position the components of a mat during the mat's manufacture into a predetermined arrangement to insure the uniformity of each mat assembled so that the mats may be interchangeably used in the field.

6 Claims, 2 Drawing Sheets

ASSEMBLY TABLE FOR MANUFACTURING OF MATS USED IN ROAD CONSTRUCTION

Related applications by the inventor are Application Ser. No. 195,371filed May 12, 1988 a continuation-in-part of Application Ser. No. 171,780 filed Feb. 29, 1988.

BACKGROUND OF THE INVENTION

This invention relates to a new and improved method and apparatus for manufacturing the component pieces used in constructing artificial mat roads. Artificial mat road surfaces are widely used and required where ground conditions are poor and there is a temporary need to move trucks and other heavy equipment in and out of a remote site. Presently temporary road structures are installed by bringing out a whole construction crew which will lay down gravel, shale or the like for a temporary road surface. Alternatively a construction crew could lay down a whole series of heavy timber boards to make a temporary road. Such board roads are especially used where environmental concerns mandate that everything that is brought into the construction area be removed, for instance, in protected wet-lands or marsh areas. The normal method of construction is to use boards anywhere from ten feet to twenty feet long and anywhere from one and a half to two and a half inches thick and from six to eight inches wide. These boards are very heavy and require manual manipulation and a lot of man power to construct board roads which sometimes run for miles.

The present state of the industry is such that supplies of boards and nails or other fasteners are separately trucked to the remote sites, and then each individual board is placed into position, requiring at least two men per board, and then after the boards are in position they are fastened together with heavy penny nails by driving the nails with sledge hammers or axes.

Such a method of construction of these board roads is obviously very labor intensive and capital intensive, but the clean up and removal of these board roads is even more labor intensive and capital intensive.

A related patent application, Ser. No. 161,780, filed Feb. 29, 1988 discusses a solution to the labor intensive and capital intensive problem presented by the present state of the art. In that patent application there is disclosed a new and improved method for constructing artificial roads. Construction of board roads is done by providing a prefabricated mat system so that the boards do not have to be nailed together in the field. The mats are configured so that they will be laid down in an interlocking relationship. The laying down of these components of a board road can be done by forklift or other equipment, and therefore can be done much more quickly and economically than the laying down and dismantling of board roads which are assembled and nailed together in the field.

SUMMARY OF THE INVENTION

The present invention provides an apparatus and method for assembly of the prefabricated mat components of the mat system disclosed in related patent application, Ser. No. 161,780, filed Feb. 29, 1988 and the Continuation in Part of that application Ser. No. 195,371 filed May 12, 1988. Those applications are hereby incorporated by reference in their entirety.

The assembly table and method of the present invention provide a means whereby a small crew of men can quickly assemble individual mats for the prefabricated road system disclosed in the related applications. Because the components of the mat system interlock together it is necessary that each of the individual mats be substantially of the same dimensions as all other mats. If the mats are so constructed then any mat may be interchangable used in any position in the board road or turnaround areas constructed with the components. In addition, storage and stacking for shipping are made easier. This invention provides a method of quickly assembling components of the board mat road system that insures every component so constructed will be of substantially identical dimensions, and therefore, can be interchangeably used at any point in the board road system. The apparatus and method herein described and depicted therefore provides both a means of increasing the speed of production of components and a quality control assurance means insuring the standard manufacture of prefabricated mats for board road systems.

DESCRIPTION OF THE PREFERRED EMBODIMENT

Figure 1:
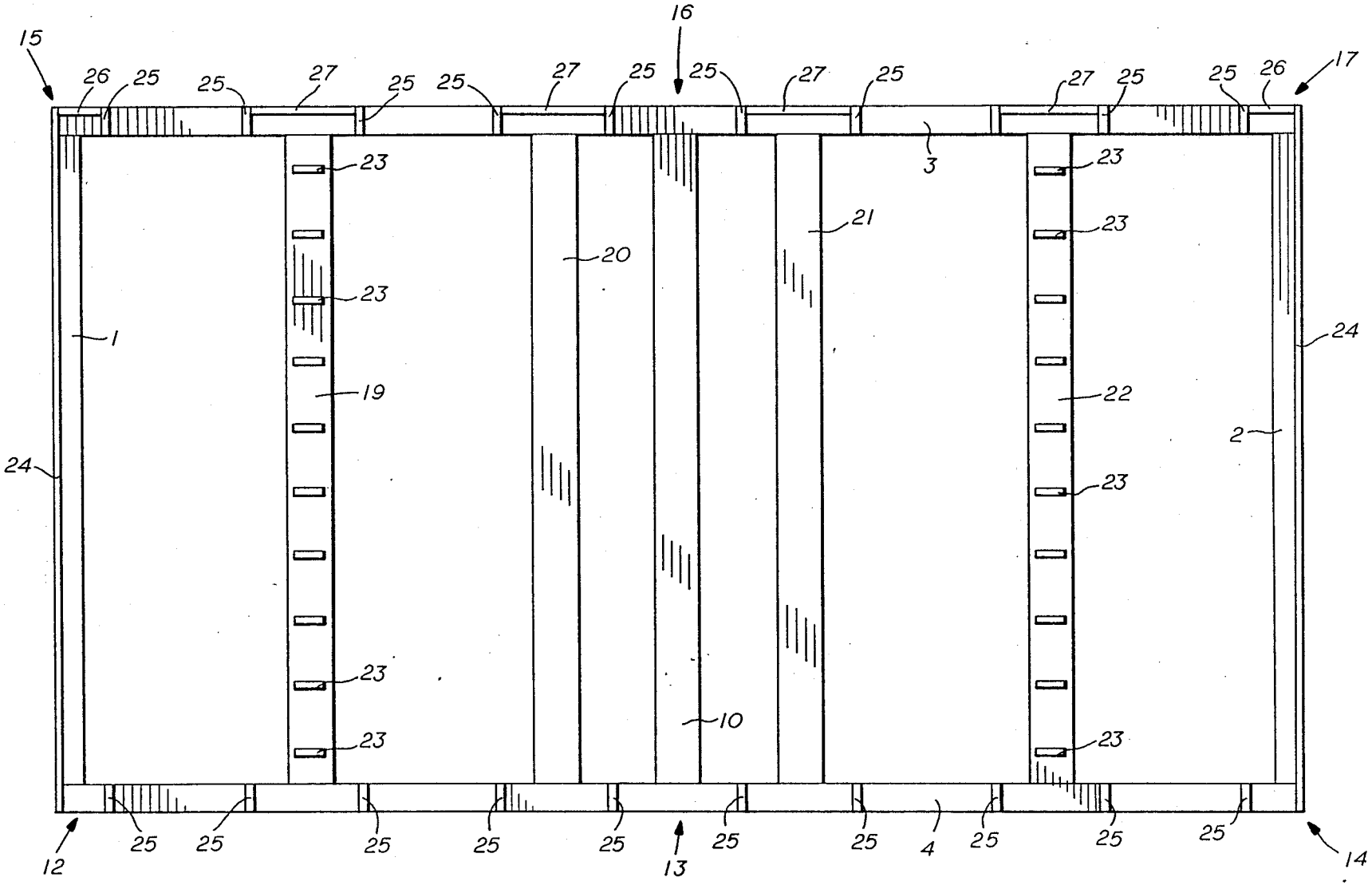
FIG. 1 is a plan view of the assembly table of the present invention.
Figure 2:
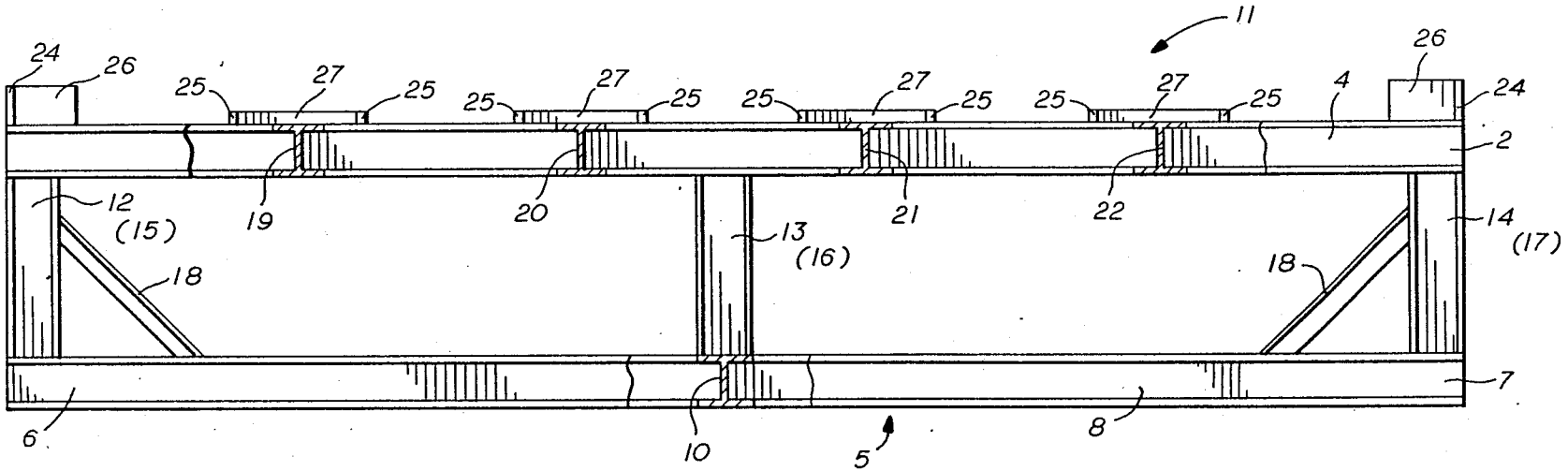
FIG. 2 is a side elevation of the assembly table of the present invention.
Figure 3:
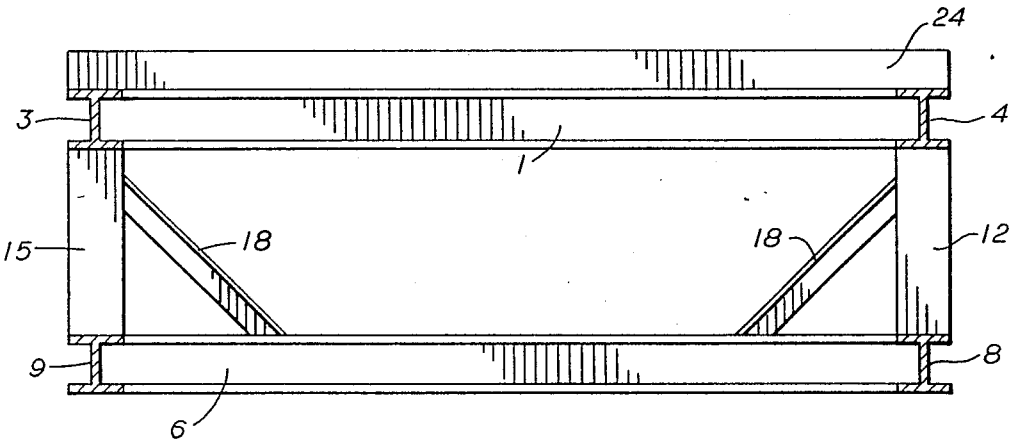
FIG. 3 is a end elevation of the present invention.

Referring now to the drawings, FIG. 1–3 depict in detail the enabling embodiment of the present invention. As depicted in FIGS. 1 and 2 the assembly table of the present invention may be constructed to steel I-beams used a longitudinal perimeter elements as will be described in more detail below. The I-beam sections and overall dimensions of the assembly table frame may be varied depending upon the size and weight of the road mat components that are to be constructed. Referring again to FIG. 1, there is depicted in plan view from the top the assembly table of the present invention. The assembly table top is comprised of four I-beams defining a rectangular perimeter. As depicted in FIG. 1 the I-beams 1 and 2 are located at the left and right of the top section respectively. In the embodiment depicted in FIG. 1 elements 3 and 4 are the perimeter I-beams sections located at the top and bottom of the upper element of the assembly table. The four perimeter I-beams are welded together end to end. In a similar manner four I-beams are welded together end to end to form a rectangular perimeter for the base 5 of the lower frame or assembly table. FIG. 2 and 3. The upper and lower perimeter elements are identically configured so that in the plan view of FIG. 1 which depicts the upper elements of the assembly table, the lower elements of the table cannot be seen but are located immediately below elements 1, 2, 3 and 4. As depicted in FIGS. 2 and 3 the lower I-beam elements are element 6 which is aligned parallel to and immediately below element 1, I-beam element 7 which is similarly positioned and aligned below I-beam element 2 of the upper perimeter frame, element 8 and 9 which are likewise similarly positioned below elements 4 and 3 respectively. See FIG. 3. For the primary embodiment of the assembly table depicted the end I-beam elements 1, 2, 6 and 7 are typically seven feet, eleven and one-half inches long and the longer perimeter elements 3, 4, 8 and 9 are typically fourteen feet, one-half inches in length.

In addition to the perimeter elements 6, 7, 8 and 9 the lower support assembly or lower frame 5 of the assembly table also includes I-beam element 10. FIGS. 1 and 2. Element 10 serves the dual purpose of providing additional bearing surface to support the weight of the assembly table and the materials used in the construction of the artificial road components, and also provides additional structural stability to the lower frame 5 of the assembly table.

The upper working surface provided by the upper frame 11 of the assembly table is attached to the lower support frame 5 by six I-beam elements. FIGS. 2 and 4. These elements are designated as I-beam elements 12–17 in FIG. 2 and 3 elements locations are also indicated on FIG. 1. In the embodiment depicted the six vertical I-beam elements 12–17 are cut from identical I-beam sections as the perimeter elements used in the top and bottom frames of the assembly table. As shown in the drawings the vertical elements 12–17 are located at each of the four corners of the assembly table, connecting corresponding corners of the upper 11 and lower 5 perimeter frames, and also connecting the upper and lower frames 4 and 5 at the mid-point of the longer upper elements 3 and 4 which are connected to the corresponding mid-points of the lower elements 9 and 8. FIGS. 2 and 3. The length of the six vertical members 12–17 is such that when four by six (4"×6") I-beam elements are used for the upper and lower frames 11 and 5 respectively, the elevation of the top surface of the upper frame 11 will be two feet, nine inches from the ground when the lower surface of the lower frame 5 is resting on the ground. Therefore, the approximate length of the six vertical elements is one foot, nine inches. An assembly table so sized will present a working surface at a convenient height from the ground for crew men to use in assembling the artificial road mat components as will be described below. Some of the components are quite heavy and it is important to have a means of quick and convenient assembly of the hand carried components.

In addition to the welded connections which are used to connect the vertical I-beam elements 12–17 at their top ends to the upper perimeter elements and at their lower ends to the bottom support elements, the vertical I-beam elements 12, 14, 15 and 17 are provided with additional bracing support. As depicted in FIGS. 2 and 3 two angle braces are provided for each of the vertical I-beam elements 12, 14, 15, and 17 located at the corners of the assembly where lower perimeter members are connected. FIGS. 2 and 3. For each vertical I-beam element that is provided with an angle brace or support 18, one angle brace is located in each plane defined by the vertical support I-beam element 12, 14, 15 or 17, and the two lower perimeter elements. The eight angle supports 18 are located at 45° angles running from the upper end of each of the vertical support members 12, 14, 15 and 17 to the lower perimeter I-beam elements 6, 7, 8 and 9 as depicted in FIGS. 2 and 3. Referring to FIGS. 2 and 3, and to vertical I-beam element 12, one of the angle support members 18 is attached to the upper end of the vertical member 12 and the support member 18 positioned at a 45° angle relative to both of the support member 12 and the member 8. This angle support member 18 is attached by a welded connection at its lower end to the horizontal perimeter I-beam element 8. In a similar manner a second 45° angled support member 18 is attached at the upper end of the vertical member 12 and is attached at its lower end to the I-beam perimeter element 6. Therefore a steel angle support member is positioned in each plane defined by a vertical corner support member 12, 14, 15 or 17 and its intersecting lower perimeter I-beam element members 6, 7, 8 and 9. These angle support members provide strength and structural stability to the assembly table assembly.

In addition to the element previously described, and referring now to FIG. 1 and 2, the upper surface of the assembly table comprises I-beam elements 19, 20, 21 and 22. These elements are located parallel to the shorter end I-beam perimeter elements 1 and 2, and are affixed at their ends to the longer perimeter elements 3 and 4. For the assembly table of the present embodiment, the center line of the interior I-beam 19 is located thirty three and five-eighths inches from the left side of the assembly table top depicted in FIG. 1. The center line of the I-beam element 20 is located thirty three and five-eighths inches from the center line of I-beam element 19, the center line of element 21 is located thirty three and five-eighths inches from the center line of I-beam element 20, the center line of I-beam element 22 is located thirty three and five-eighths inches from that of I-beam element 21 and from the right end of the assembly table top depicted in FIG. 1. For this primary embodiment depicted the interior I-beam elements 19, 20, 21 and 22 are fabricated from the same I-beam section as the perimeter elements. The interior elements 19-22 are welded at their ends to the longer of the perimeter I-beam elements 3 and 4 and are parallel to the shorter of the perimeter elements 1 and 2 and are also so welded that the upper surface of the I-beams 19-22 are flush with the upper surfaces of the I-beams 3 and 4.

The interior elements 19 and 22 are each provided with ten positioning guides 23 as depicted in FIG. 1. In the embodiment illustrated these positioning guides are fabricated from threequarter ($\frac{3}{4}$") inch flat bar or narrow metal plate for inches long, and these flat positioning guides are welded at intervals along one edge to the upper surface, ten each to the upper surface of I-beam element 19 and I-beam 22. When so positioned and welded to the upper surface of these I-beams, the positioning guides provide a locating and guiding means for positioning within the assembly table nine timbers which will be used to fashion a component unit of the artificial road surface in a manner that will be described in more detail below. For timber boards that are nominally 8" in width, the ten positioning elements or guides 23, on each of the beams 19 & 22, will be located $8\frac{3}{4}$ inches apart on centers to symmetrically position the nine longitudinal timbers.

As shown in FIGS. 1–3, additional positioning stops 24 are located along the outer and upper end perimeter elements of the assembly table top in welded connection along the outer edges of the left and right ends of the assembly table top as depicted in FIG. 1. As depicted in FIGS. 2 and 3, these positioning stops run the length of the assembly table top along the outer upper surfaces the shorter two sides. As with the previously described positioning elements 23, these positioning stops 24 provide a means for guiding and holding in place timbers or other types of components that will be used in fabricating the artificial road construction mat elements in a manner that will be described in more detail below. In the embodiment depicted these two end positioning stops 24 are fabricated of one-half by four inch flat bar or narrow metal plate, and each is seven feet, eleven and one-half inches in length.

Referring now to FIG. 1, there are depicted positioning elements 25, 26 and 27. As detailed in FIGS. 1 and 2, elements 26 are fabricated of half inch by four inch steel plate, are eight inches long, and are welded along the length of element 3 with the eight inch length parallel to the longitudinal axis of the perimeter element 3. The two positioning stops 26 are welded to the outer edge of the upper flange at each end of I-beam element 3, with the four inch dimension projecting vertically as depicted in FIGS. 1 and 2. Positioning stops 27 are fabricated from steel flat bar one-half inch thick by one and a half inches tall by sixteen inches in length, with each positioning stop 27 positioned at intervals along the length of element 3 so that it is aligned with the positioning stops 26, welded to the outer and upper flange of the I-beam element 3, with the one and a half inch dimension projected upwards as depicted in FIGS. 1 and 2. The sixteen inch dimension of the positioning stops 27 runs parallel to the longitudinal axis of the I-beam element 3, and each of the four positioning stops 27 is located at intervals along the length of element 3 so that the center point of the sixteen inch dimension is aligned with the center line of one of the interior assembly table i-beams 19, 20, 21 or 22 as depicted in FIGS. 1 and 2. The purpose and function of these stop elements 27 will be described in more detail below.

Also depicted in FIG. 1 are the narrow metal plate guide elements 25 which are fabricated from half inch by one and a half inch by four inch steel flat bar. These guide elements are positioned at either end of the stop elements 27 previously described as depicted in FIG. 1. The four inch dimension of these guide elements runs perpendicular to the longitudinal axis of I-beam elements 3 and 4, and is welded along its lower side to the upper surfaces of either I-beam 3 or 4. It should be noted that although the stop elements 27 are provided at intervals on only one side of the assembly table top, the guide elements 25 are positioned along both I-beam 3 and I-beam 4. The purpose of this configuration will become clear when the operation and method of assembly is explained below. As noted although no elements 27 are located along the length of beam 24, the elements 25 are positioned in corresponding locations to the elements 25 that are located along and across the I-beam element 3. Two guide elements 25 are provided and welded to the upper surface of the longer perimeter beams at each end of the interior beams 19, 20, 21 and 22. Therefore, there are sixteen of the guide elements 25 positioned at similar locations about the interior elements 19, 20, 21 and 22. In addition to that there are four additional guide elements 25 which are located one each near the ends each of the two longer perimeter beams 3 and 4. In particular for the embodiment illustrated a guide element 25 is located eight inches from the end of each of the I-beams 3 and 4, and is positioned with the longer axis of the guide element 25 perpendicular to the longitudinal axis of the I-beam elements 3 and 4.

Although the primary embodiment has been described with specific references to section sizes of the steel materials that the assembly table is constructed from, it should be obvious that the assembly table could be constructed from alternative materials, for instance could be constructed entirely of wood. It should also be obvious that the dimensions of the structural and guiding elements that make up the assembly table could be changed to provide mat components of varying sizes and they could also be changed to accommodate mat components of varying properties that provide either less or more strength from the assembly table to support the mat component, or that require additional cross-bracing or support from the assembly table to support the elements that will combine to comprise a component of an assembled mat. The strength of materials should be sufficient also to allow for drawing and holding warped or mis-shapen elements into line prior to fastening. This will allow for warped or used components to be used with no adverse effect upon the ultimate interchangeability of assembled mats in the field. Therefore, although this invention has been described with specific materials and sections, it is not to be understood as limited thereto, and many variations will be obvious to those skilled in the art in light of the teachings of this specification.

DESCRIPTION OF THE USE OF THE PRESENT INVENTION

In use the assembly table of the present invention is utilized as will now be described. Assuming that the mats are to be fabricated from heavy timbers and not an alternative material or composition of materials, the timbers will be supplied to the assembly area cut to a standard length. For the embodiment described the standard length would be fourteen feet even. Timbers of this size can be handled by two men to a timber. Therefore with one man at each end of the timber the two men will simply carry the timber to the assembly table and drop the timber into one of the nine spaces defined by the two sets of guide elements 23. FIG. 1. The nine timbers will be carried to the assembly table and positioned within the nine spaces provided. By dropping the end of the timber first and then sliding it down against the end stop member 24, the quality of the completed mats will be insured in that the ends of the timber will be square. This is important because of the need for a prefabricated mat to interlock and fit with other similar prefabricated mats as has previously been described.

Once the nine timber members have been longitudinally positioned within the locations provided and defined by the guide elements 23, the cross-piece timbers will be positioned at intervals perpendicularly to the longitudinal timbers. For the assembly table depicted in this primary embodiment, ten cross-member timbers are required. As with the longitudinal timber members, the cross-member timbers can be easily carried and positioned by a crew of two men. The timbers are simply carried to the assembly table and positioned parallel to the elements 1, 2 and 19, 20, 21 and 22. That is, one at a time each of the crosspiece timber elements is slidingly positioned against either the stops 26 or 27 that are provided along I-beam 3. As the stops are positioned and aligned along I-beam 3, it is insured that the ends of the mats will all be relatively square. Each of the ten cross-piece timbers positioned against a stop element 26 or 27, is also positioned at intervals between two guide members 25, or between guide members 25 and the end stop pieces 24, so that the cross timbers will be parallel to I beams, 1, 2, 19, 20, 21, 22.

After the boards or timbers have been positioned correctly within the assembly table another member of the assembly crew who is provided with an automatic nail gun, which can be either electrically, pneumatically or hydraulically powered, fastens the correctly positioned timber members into a prefabricated artificial road mat component unit. The preferred method of doing this nailing is simply to have the man armed with the nail gun step on top of the assembly table, which he can easily do because the table only about waist high from the ground surface. The man with the nail gun can then simply walk the length of the cross-piece boards which run from beam 3 to beam 4. The preferred method of nailing is to use four heavy penny nails at each end of the timber of the two outer timbers which are positioned directly over beams 1 and 2 of the assembly table and to put a double row of nine nails or eighteen heavy penny nails along each length of the timber members that are positioned over beams 1 and 2 of the assembly table. By walking along the top of one of the longitudinal boards the man with the nail gun can proceed to the timbers which are located above beam 19 of the assembly table. It should be noted that although only one timber is positioned within the guide elements 25 over each of beams 1 and 2 respectively, two timber elements are positioned within the guide elements 25 directly over each of the interior beam elements 19, 20, 21 and 22. The method of nailing the interior timber elements is the same as that for the two end timbers, however, only half the number of nails are used. That is two nails are used at each end of the interior timbers which are located over beams 19, 20, 21 and 22 and a single row of approximately nine penny nails is used down the length of each of the timbers located over the interior I-beams 19, 20, 21 and 22 of the assembly table.

By proceeding in such a manner the man armed with the nail gun can simply walk the length of the beams and hammer the nails automatically into the timbers, by proceeding first from the timber located over beam 1 and then to the timbers over beam 19 and then to the timbers over beam 20 and so on until he has completed nailing the cross-piece timbers by nailing the timber located over beam 2. After the nails have been installed to fasten the cross-piece timbers to the longitudinal timbers, the completed mat unit can be removed from the assembly table with a forklift or by any other similar means. Removal of the timber mat with a forklift provides the additional advantage that the unit can be moved to a storage area, or can be directly loaded onto a truck for transport, or can be positioned in the field as desired if the assembly table has been constructed at a field location.

As an alternative arrangement, two such assembly tables can be provided in order that the two to four man crew that positions the timbers within the table can be positioning the timbers within a table while the one man automatic nailer is nailing timbers that are positioned within the second assembly table. In this manner a more continuous assembly processes can be carried on.

As yet another alternative to the described method of assembly utilizing a two to four man crew for positioning timbers and one man armed or provided with an automatic nail gun, it might be desirable to set up a more automated assembly line. The table would be provided with a conveyor belt process for moving the timbers to the assembly table, with automated locators to position the timbers within the guide element of the assembly table, and with one automatic nail machine which would simply nail all the timbers into place at once. Alternately, an arrangement of nail guns could be moved over the timbers and triggered to fire at appropriate times, to correctly nail the timbers as previously described, or the assembly table could be set up to move under a row of nail guns to achieve the same result. Similar automated processes could remove the assembled mat unit from the table top and transport it to storage. The whole procedure can be controlled by microprocessors, as is common in today's industrial practice.

Although the design of this assembly table provides for a manufacture of construction mats which are designed to be reused many times, considering the type of rough service they will receive in the construction in industry, even these mats are consumables. Therefore it might be desirable to provide for mass production of such timber mat units. The just described embodiment providing for an automated assembly line for production and with a similar automated line for transport and storage would fill any such needs.

While this invention has been described by means of a specific example and specific alternative embodiments, it is not to be limited thereto. Obvious modifications will occur to those skilled in the art without departing from the spirit and scope of the invention.

What is claimed is:

1. A structure for positioning component elements of an artificial road construction system into position within a predetermined arrangement, with longitudinal and cross piece components for assembly wherein said structure comprises a base assembly, a support assembly fixed to said base assembly and a top assembly connected to said support, assembly wherein the top assembly of the structure comprises:

(a) four longitudinal elements wherein the first and second longitudinal elements, are of even length and the third and fourth elements, with guide means and stop means, are of relatively longer length than said first and second elements and wherein said four elements are positioned horizontally within a single plane and are fastened end to end to form a rectangular perimeter presenting an upper surface with an outer edge;

(b) a plurality of horizontal interior longitudinal members, each of said longitudinal members each affixed at one perpendicularly to one of said longer perimeter elements and at its other end to the opposite longer perimeter element so that each of said interior horizontal elements is affixed parallel to said shorter perimeter elements and within the same plane as the other interior elements;

(c) guide means are fixed to the upper surfaces of the outer two of the interior horizontal longitudinal members, and to the two longer perimeter beams, and stop means are provided on the two shorter perimeter beams and on one of the longer perimeter beams;

(d) wherein said guide means and stop means are positioned so that the component elements of an artificial road unit under construction may be positioned as desired to assure uniformity and interchangability of completed artificial road mats; and wherein;

(e) said base assembly is formed from five longitudinal members fashioned into a rectangular frame, wherein all five longitudinal members are positioned horizontally to rest directly on the ground, the base assembly comprising first and second perimeter members of even length and relatively longer third and fourth perimeter members of even length connected end to end to form a rectangle, and wherein the fifth longitudinal member is of even length with the first and second longitudinal members and is connected parallel to the first and second longitudinal members with the first end of the fifth longitudinal member connected to the mid-point of the third member and the second end of the fifth longitudinal member connected perpendicularly to the mid-point of the fourth longitudinal member.

2. The invention of claim 1, wherein said guide means and stop means affixed to said top perimeter longitudinal elements comprise:

(a) stop means attached to and projecting upwardly from the perimeter surface and edge of each of said shorter perimeter elements running the length of each of said shorter perimeter elements, parallel to the longitudinal axis of each of said shorter perimeter elements;

(b) stop means positioned at intervals in a line along the outer edge of one of the two longer perimeter beam elements, the stop means fixed to the upper surface of the beam at locations corresponding to the locations of the horizontal interior longitudinal members;

(c) guide means positioned at intervals along the length of each of the two longer perimeter beam elements, each guide means fixed to the upper surface of a beam perpendicular to the longitudinal axis of that beam, the guide means located to position the cross piece of a mat assembly; and (d) guide means positioned at intervals along the length of the two outermost interior horizontal longitudinal members, each guide means fixed to the upper surface of a horizontal member perpendicular to the longitudinal axis of that member and located to position the longitudinal pieces of a mat assembly.

3. The invention of claim 2 wherein the base assembly, support assembly, and top assembly are fabricated from metal structural shapes, and wherein:

(a) the top means projecting upwardly from each of the two shorter perimeter elements is formed from a narrow metal plate running the length of the perimeter element, and each plate is welded along a lower edge to the upper surface of a perimeter element at the outermost edge;

(b) the stop means at intervals along one of the two longer perimeter beams, and the guide means on both of the longer perimeter beams, and the guide means positioned on the two interior horizontal elements are formed from narrow metal plates welded along their lower edges to the upper surfaces of elements of the top assembly.

4. The invention of claim 1 wherein:

(a) the first and second longitudinal perimeter elements, are of even length and the third and fourth perimeter elements, with guide means and stop means, are of relatively longer length than said first and second elements and wherein said four perimeter elements are positioned horizontally and are fastened in end to end relationship to form a rectangle;

(b) a plurality of horizontal interior longitudinal members, each of said longitudinal members affixed at a first end perpendicularly to one of said longer perimeter elements and at a second end to the second longer perimeter element so that each of said interior horizontal elements, is affixed parallel to said shorter perimeter elements and within the same plane as the other interior elements: said plane which is defined by the perimeter elements;

(c) guide means are fixed to the upper surfaces of the outer two of the interior horizontal longitudinal members; and, (d) wherein said guide means and stop means are positioned so that the component elements of an artificial road unit under construction may be positioned as desired to assure uniformity and interchangability of completed artificial road mats.

5. The invention of claim 4 wherein:

(a) stop means attached to and projecting upwardly from the surface of each of said shorter perimeter elements running the length of each of said perimeter elements, parallel to the longitudinal axis of each of said perimeter elements.

(b) stop means positioned at intervals in a line along the outer edge of one of the two longer perimeter beam elements, the stop means fixed to the upper surface of the beam at locations corresponding to the locations of the horizontal interior longitudinal members;

(c) guide means positioned at intervals along the length of each of the two longer perimeter beam elements, each guide means fixed to the upper surface of a beam perpendicular to the longitudinal axis of that beam, the guide means located to position the cross piece of a mat assembly; and, (d) guide means positioned at intervals along the length of the two outermost interior horizontal longitudinal members, each guide means fixed to the upper surface of a horizontal member perpendicular to the longitudinal axis of that member and located to position the longitudinal members of a mat.

6. The invention of claim 5 wherein:

(a) the stop means projecting upwardly from each of the two shorter perimeter elements is formed from a narrow metal plate running the length of the perimeter element, and the plates are welded along their lower edges to the upper surfaces of the perimeter elements at their outer edge;

(b) the stop means at intervals along one of the two longer perimeter beams, and the guide means on both of the longer perimeter beams, and the guide means positioned on the two interior horizontal elements are formed from narrow metal plates welded along their lower edges to the upper surfaces of elements of the top assembly.

* * * * *